US005078251A

United States Patent [19]

Hayashi et al.

[11] Patent Number: 5,078,251

[45] Date of Patent: Jan. 7, 1992

[54] COIN SELECTING APPARATUS

[75] Inventors: Yukichi Hayashi, Sakado; Yonezo Furuya, Hatoyama; Ichiroh Fukuda, Kawagoe; Masaki Akagawa, Hatoyama; Osamu Kobayashi, Saitama, all of Japan

[73] Assignee: Kabushiki Kaisha Nippon Conlux, Tokyo, Japan

[21] Appl. No.: 455,880

[22] Filed: Dec. 29, 1989

Related U.S. Application Data

[63] Continuation of Ser. No. 373,710, Jul. 3, 1989, abandoned, which is a continuation of Ser. No. 139,667, Dec. 30, 1987, abandoned.

[30] Foreign Application Priority Data

Jan. 12, 1987 [JP] Japan ..... 62-4425
Jan. 30, 1987 [JP] Japan ..... 62-19773
May 7, 1987 [JP] Japan ..... 62-111431

[51] Int. Cl.[5] ..... G07D 5/08
[52] U.S. Cl. ..... 194/318
[58] Field of Search ..... 194/317, 318, 319

[56] References Cited

U.S. PATENT DOCUMENTS 3,682,286 8/1972 Prumm ..... 194/317
4,091,908 5/1978 Hayashi et al. ..... 194/318
4,124,111 11/1978 Hayashi ..... 194/319 X

*Primary Examiner*—F. J. Bartuska
*Attorney, Agent, or Firm*—Diller, Ramik & Wight

[57] ABSTRACT

A coin selecting apparatus includes a coin detection coil disposed in a coin channel for outputting a coin detection signal having a waveform changing gradually as the coin passes in the channel and uniquely accordance with the kind of the coin, and window device having a plurality of different windows for corresponding coins to be detected for producing a pulse signal when the coin detection signal is in a window. A timer device monitors the time duration of the pulse signal to thereby determine the validation and kind of the coin in accordance with the output from the timer device. A counter counts pulse signals produced by the window device to thereby determine the validation and kind of the coin in accordance with the count therein.

22 Claims, 11 Drawing Sheets

COIN SELECTING APPARATUS

This application is a continuation of application Ser. No. 07/373,710, filed Jul. 3, 1989; now abandoned, which is a Rule 62 continuation of U.S. application Ser. No. 07/139,667 filed Dec. 30, 1987; now abandoned.

BACKGROUND OF THE INVENTION

1. Field of the Invention

This invention relates to a coin selecting apparatus used in vending machines, exchanging machines, service devices, etc., and more particularly to improvements to an electronic coin selecting apparatus which determines the kind of a coin electronically.

2. Description of the Related Art

Conventionally, there are a mechanical coin selecting apparatus which discriminates a coin by checking the properties of a coin mechanically and an electronic coin selecting apparatus which senses the properties of a coin electronically and discriminates the coin in accordance with the sensing output. The latter has an enlarged range of applications because its accuracy of discrimination is excellent and it can be miniaturized.

Generally, an electronic coin selecting apparatus includes an oscillation coil disposed on one side of a coin channel and excited by a signal having a predetermined frequency, and a receiving coil disposed on an opposite side and coupled electromagnetically to the oscillation coil whereby the validity and kind of the coin are determined on the basis of an attenuating voltage waveform from the receiving coil generated due to passage of a coin and the coin is discriminated in accordance with the results of the determination. In other words, the fact that the maximum attenuation voltage of an attenuating voltage waveform produced by the receiving coil due to passage of a coin varies depending upon that coin has been noticed. The validity and kind of a coil are determined depending upon whether the attenuating voltage waveform produced by the receiving coil falls in a predetermined range (window) of determination for a maximum attenuation voltage for the corresponding coin to be discriminated.

However, according to this arrangement, with a coin which causes the receiving coil to produce a greatly attenuating voltage waveform, a signal indicative of the determination of a genuine coin will be produced each time the voltage waveform traverses an allowable range for another coin.

With a coin whose voltage waveform attenuates greatly, a plurality of signals indicative of the determination of a genuine coin will be produced by sole depositing of the coin. In order to cope with this situation, a maximum attenuation point sensing circuit is conventionally provided which senses that the attenuating voltage waveform produced by the receiving coil reaches a maximum attenuation point, and the output from the receiving coil is determined synchronously with a peak signal from the sensing circuit.

However, the sensing circuit includes a unit which stores the outputs from the receiving coil sequentially, a unit which detects the output from the receiving coil being reversed and starting to rise, etc., so that it itself is considerably complicated and renders the entire circuit structure very complicated.

Since the peak signal output from the maximum attenuation point sensing circuit is a discontinuous signal which is produced only when the output from the coil attenuates to a maximum degree, the sensing circuit may operate erroneously due to possible noise similar in magnitude to the peak signal and produced at a time other than when the output from the receiving coil attenuates to a maximum degree. Therefore, it is an object of this invention to provide a coin selecting apparatus which is less likely to operate erroneously and has a simple structure.

SUMMARY OF THE INVENTION

In order to achieve the above object, in a coin selecting apparatus according to this invention, a coin detection coil is disposed in a coin channel. The coil produces a coin detection signal having a waveform changing gradually as the coin passes in the channel and uniquely in accordance with the kind of the coin. Window means are provided which include a plurality of different windows set for corresponding coins to be detected for producing a pulse signal so long as the coin detection signal is within a window. The time duration in which the pulse signal exists is monitored by timer means and the validation and kind of the coin is determined in accordance with the output from the timer means.

The number of pulse signals produced by the window means is counted by counting means and the validation and kind of the coin are determined in accordance with the count in the counting means.

According to this invention, the validation and kind of a coin are determined in accordance with the output from timer means and/or the output from counting means. For example, when a coin to be detected is a genuine one, the output from the receiving coil decreases gradually as the coin passes in the channel, reaches an allowable range window preset for the coin to be detected, and then rises to its original level. The pulse width of the pulse signal obtained when the output from the receiving coil reaches the allowable range differs from that of a pulse signal obtained when the output from the receiving coil solely traverses another window. Therefore, the pulse width of the pulse signal is monitored by timer means in this invention.

If the output from the receiving coil traverses n windows until it reaches the allowable range, n signals will be produced from the window means until the coil output reaches the allowable range, one signal is produced when the coil output reaches the allowable range, and n signals will be produced until the coil output returns to its original level from the allowable range, so that $(2n+1)$ signals in all are produced. The value $(2n+1)$ changes depending upon the kind of a coin to be detected. In contrast, if a coin to be detected is a false one, the output from receiving coil does not reach any window or only traverses windows as the coin passes in the channel, so that the count in the counting means in that case becomes 2m where m is 0 or an integer. Thus in this invention the validation and kind of a coin to be detected is determined in accordance with both the monitoring output from the timer means and the count in the counting means.

According to this invention, a coin selecting apparatus is provided which hardly performs an erroneous operation and which is simplified greatly in structure because the use of peak signals is not required at all.

DESCRIPTION OF THE PREFERRED EMBODIMENT

Figure 1:
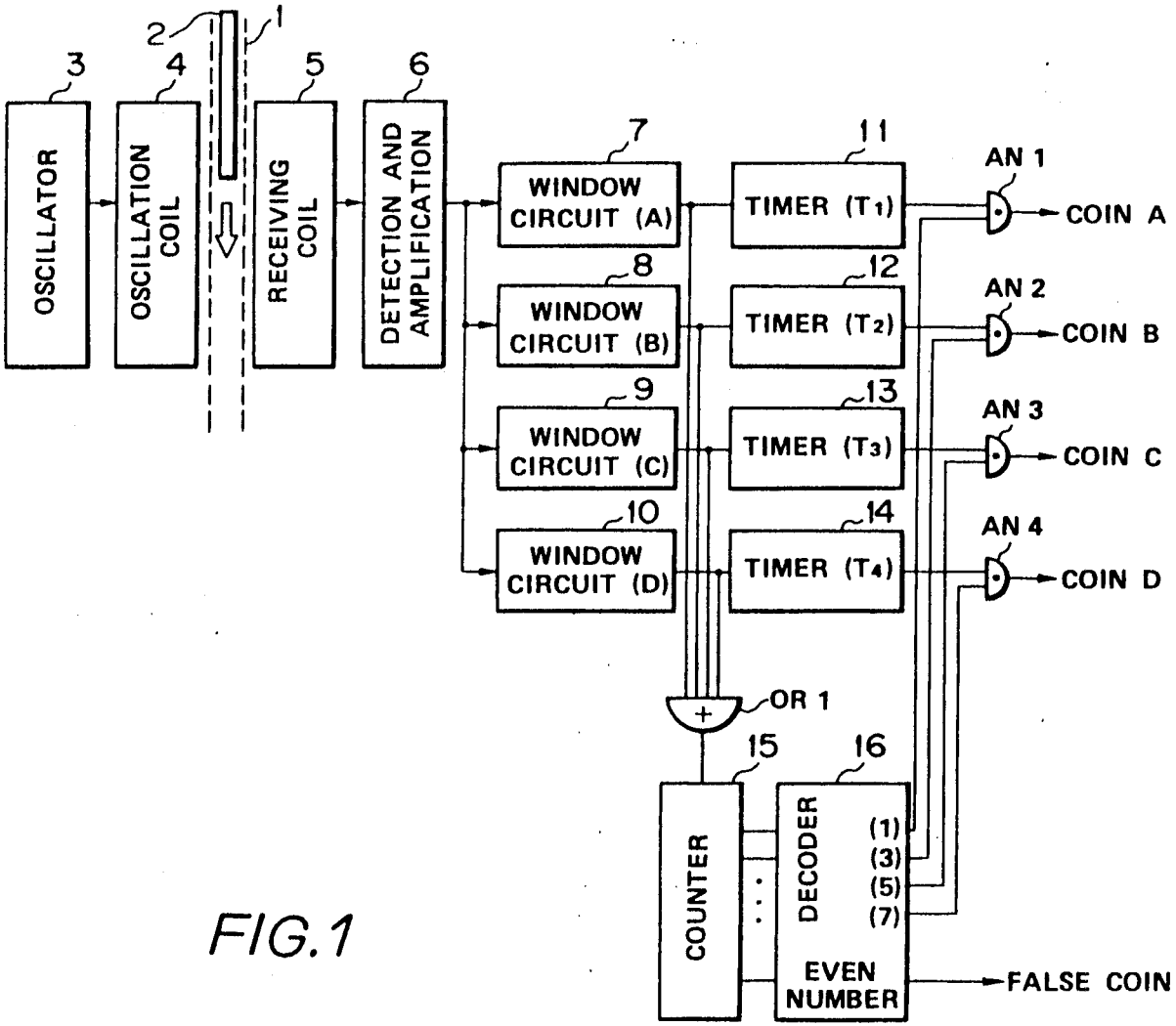
FIG. 1 is a block diagram showing one embodiment of this invention.

FIG. 1 shows one embodiment of a coin selecting apparatus according to this invention. In FIG. 1, an oscillation coil 4 which is excited by the output from an oscillator 3 is disposed on one side of a coin channel 1. The oscillation frequency from the oscillator 3 differs depending upon the property (material or shape), to be marked, of a coin 2 to be detected. For example, 25 KHz is used when the material is to be marked while 100 KHz is used when the shape is to be marked. A receiving coil 5 is disposed on the other side of the coil channel 1 opposite the oscillation coil 4. In this embodiment, the validation and kind of the coin 2 are determined on the basis of the output signal or an attenuating voltage waveform from the receiving coil 5 produced when the coin 2 passes between the coil 4 and 5 in the channel. The output signal from the receiving coil 5 is detected and amplified by a detection and amplification circuit 6, the output from which is then applied to window circuits 7, 8, 9 and 10 where corresponding allowable ranges or windows of maximum attenuation voltage for A-, B-, C- and D coins are set. The window circuits 7–10 each produce a pulse rising when the output from the amplification circuit 6 enters it and falling when the output from the amplification circuit 6 disappears from the window. These windows circuits 7–10 may be constituted by a well-known window comparator. The outputs from the window circuits 7–10 are applied to corresponding timers 11, 12, 13 and 14.

The timers 11–14 each start a timekeeping operation when the input pulse signal rises and output a high level signal when the pulse signal does not fall even if the set timer times T1, T2, T3 and T4 have past. When the timer 11 outputs a high level signal as the coin 2 passes between the oscillation and receiving coils 4 and 5, it is determined that the coin is A-coin. When the timer 12 outputs a high level signal, it is determined that the coin is B-coin. When the timer 13 outputs a high level signal, it is determined that the coin is C-coin. When the timer 14 outputs a high level signal, it is determined that the coin is D-coin. When any one of timers 11–14 outputs no high level signal, it is determined that the coin 2 is a false one.

Figure 2:
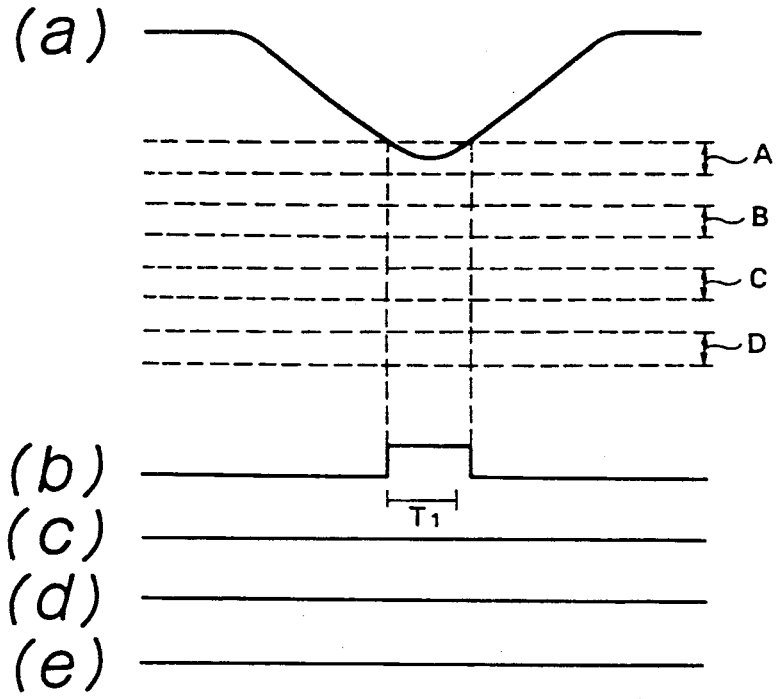
FIGS. 2–11 are waveforms illustrating the operation of the embodiment shown in FIG. 1.
Figure 3:
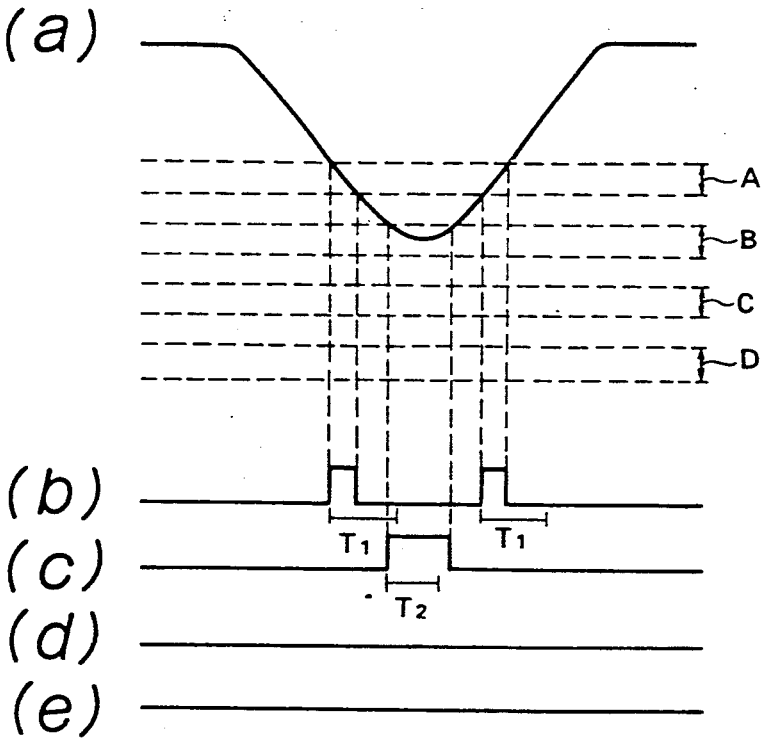
Figure 4:
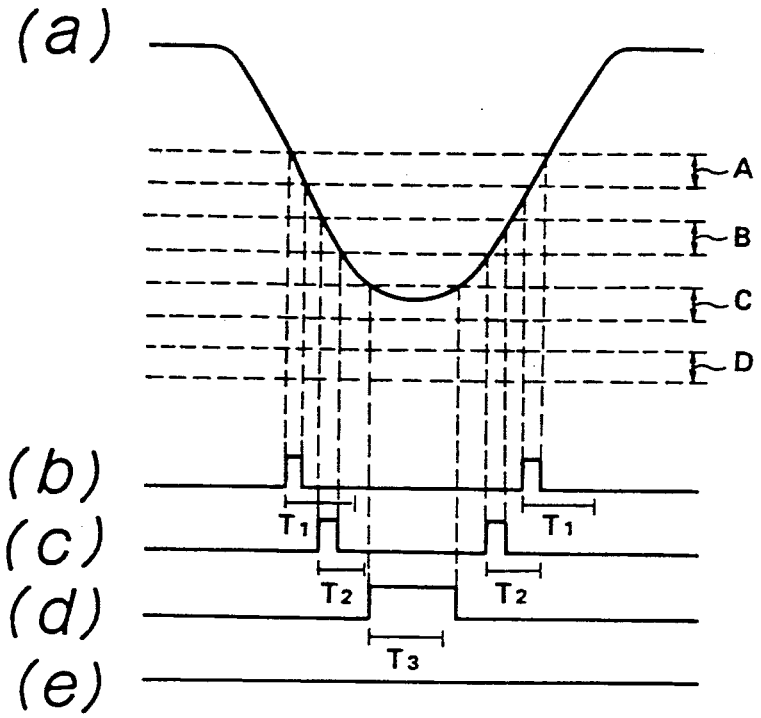

FIG. 2–5 show respective attenuating voltage waveforms output from the detection and amplification circuit 6 as genuine A-, B-, C- and D-coins each pass between the oscillation and receiving coils 4 and 5, and the output pulses from the window circuits 7–10. In FIGS. 2–5, the windows A, B, C and D show corresponding allowable ranges of maximum attenuation voltage (genuine-coin determination ranges) for A-, B-, C- and D- coins. FIGS. 2(*b*), (*c*), (*d*), (*e*); FIGS. 3(*b*), (*c*), (*d*), (*e*); FIGS. 4(*b*), (*c*), (*d*), (*e*); and FIGS. 5(*b*), (*c*), (*d*), (*e*) show the output pulses from the corresponding window circuits 7, 8, 9 and 10.

In the case of A-coin, the output from the detection and amplification circuit 6 attenuates to window A and then rises to return to its original level, as shown in FIG. 2. In that case, since the attenuating voltage waveform does not at all traverse the windows B, C and D for other coins, only one pulse is produced by the window circuit 7. In that case, the pulse width of the output pulse from the window circuit 7 is wider than the pulse width T1 set in the timer 11, so that only timer 11 outputs a high level signal.

In the case of B-coin, the attenuating voltage waveform attenuates to the window B and then rises to return to its original level, as shown in FIG. 3. In that case, the attenuating voltage waveform traverses the window A once when it attenuates and rises, respectively. The pulse width of each of the output pulses from the window circuit 7 is narrower than the set pulse width T1 in the timer 11, so that no high level signal is produced from the timer 11. However, the pulse width of a pulse signal output from the window circuit 8 is wider than the set pulse width T2 in the timer 12, so that timer 12 produces a high level signal. Eventually, only timer 12 produces a high level signal.

In the case of C-coin, the attenuating voltage waveform attenuates to the window C and then rises to return to its original level, as shown in FIG. 4. The attenuating voltage waveform traverses the windows A and B when it attenuates, and also traverses the windows A and B when it rises. The pulse widths of the output pulses from the window circuits 7 and 8 are narrower than the set pulse widths T1 and T2 in the timers 11 and 12, respectively, so that the timers 11 and 12 do not produce a high level signal. However, the pulse width of a pulse signal output from the window circuit 9 is wider than the set pulse width T3 in the timer 13, so that timer 13 produces a high level signal.

Figure 5:
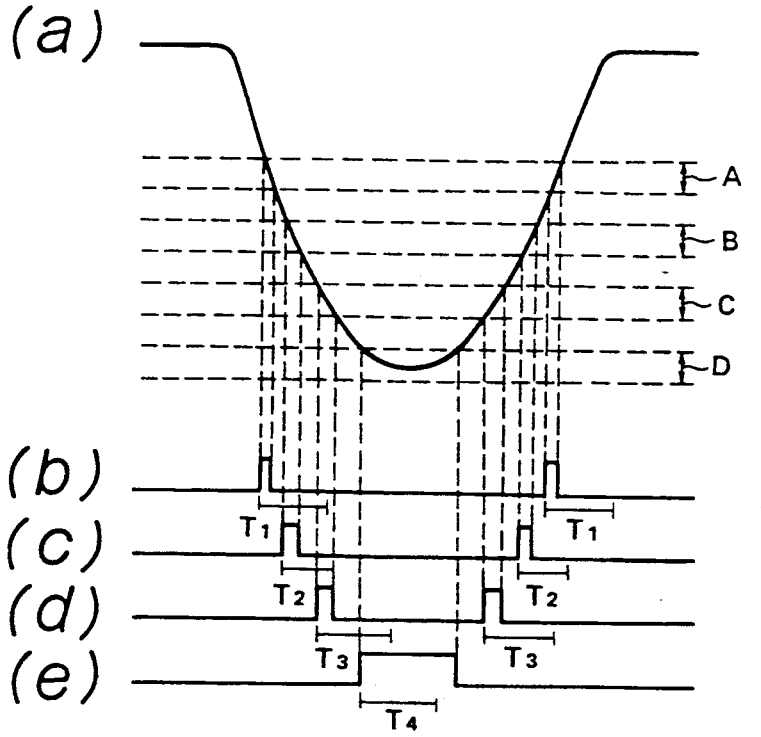

In the case of D-coin, the attenuating voltage waveform attenuates to the window D and then returns to its original level, as shown in FIG. 5. The voltage waveform traverses the windows A, B and C when it attenuating and when it rises, respectively. The pulse widths of the output pulses from the window circuits 7, 8 and 9 are narrower than the set pulse widths T1, T2 and T3 in the timers 11, 12 and 13, respectively, so that timers 11, 12 and 13 do not produce a high level signal. However, the pulse width of a pulse signal output from the window circuit 10 is wider than the set pulse width T4 in the timer 14, so that timer 14 produces a high level signal.

In summary, when the coin passing through the coin channel 1 is A-coin, only timer 11 produces a high level signal; if the coin is B-coin, only timer 12 produces a high level signal; if the coin is C-coin, only timer 13 produces a high level signal; and if the coin is D-coin, only timer 14 produces a high level signal.

Figure 6:
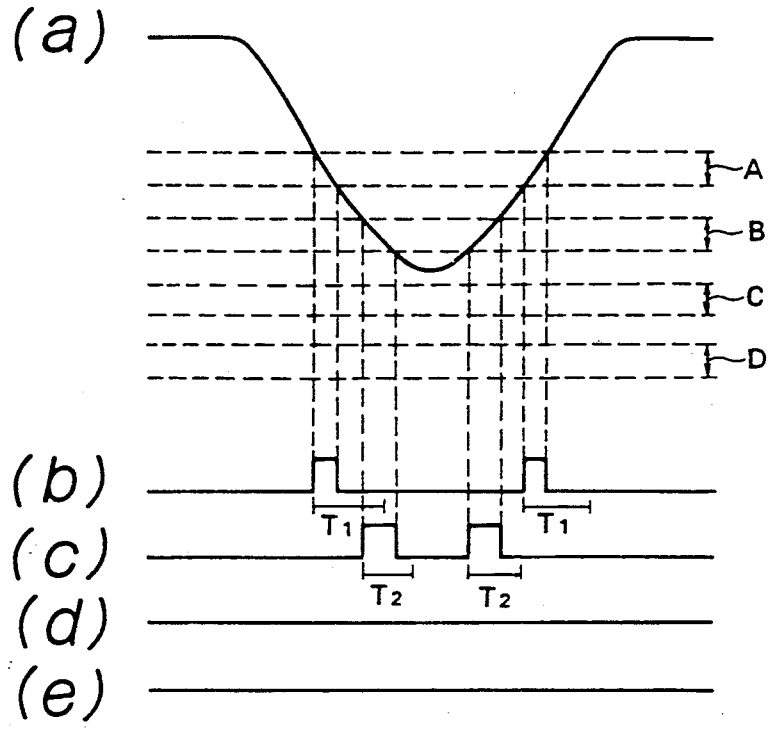

FIG. 6 illustrates one example of waveforms produced when the coin 2 passing through channel 1 is a false one. In that case, the maximum attenuation voltage of the attenuating voltage waveform does not belong to any of the windows A, B, C and D. For example, as shown in FIG. 6, the voltage waveform traverses the window A and B and returns to its original level. The pulse width of pulse signals output from the window circuits 7 and 8 is narrower than the set pulse widths T1 and T2 in the timers 11 and 12 and eventually timers 11 and 12 do not produce a high level signal.

As just described above, when the coin passing through the channel 1 is a false one, any of timers 11, 12, 13 and 14 does not produce a high level signal.

The outputs from timers 11, 12, 13 and 14 are input to corresponding AND gates AN1, AN2, AN3 and AN4.

The outputs from the window circuits 7, 8, 9 and 10 are input via an OR gate OR1 to a counter 15 which is arranged to be reset by appropriate means before a coin enters between the oscillation and receiving coils 4 and 5. As the coin 1 passes between the coils 4 and 5, the counter 15 counts the pulses produced from the window circuits 7, 8, 9 and 10.

FIGS. 7–10 show attenuating voltage waveforms output from the detection and amplification circuit 6 as respective genuine A-, B-, C- and D-coins pass between the oscillation and receiving coils 4 and 5, and the output pulses from the window circuits 7, 8, 9 and 10. The windows A, B, C and D in FIGS. 7–10 show allowable ranges of maximum attenuation voltage (genuine-coin determination ranges) for A-, B-, C- and D-coins, respectively. The reference characters (b), (c), (d) and (e) of FIG. 7–10 denote output pulses from the window circuits 7, 8, 9 and 10, respectively.

Figure 7:
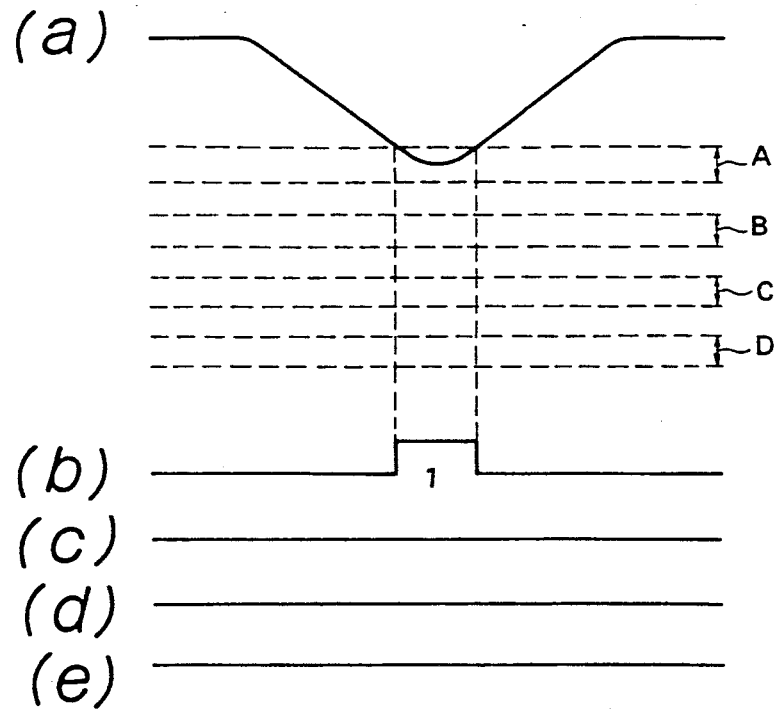

First, in the case of A-coin, the output from the detection and amplification circuit 6 attenuates to window A and then rises to return to its original level, as shown in FIG. 7. In that case, the voltage waveform does not at all traverse the windows B, C and D for other coins, so that only the window circuit 7 produces one pulse. Therefore, the count in the counter 15 becomes "1".

Figure 8:
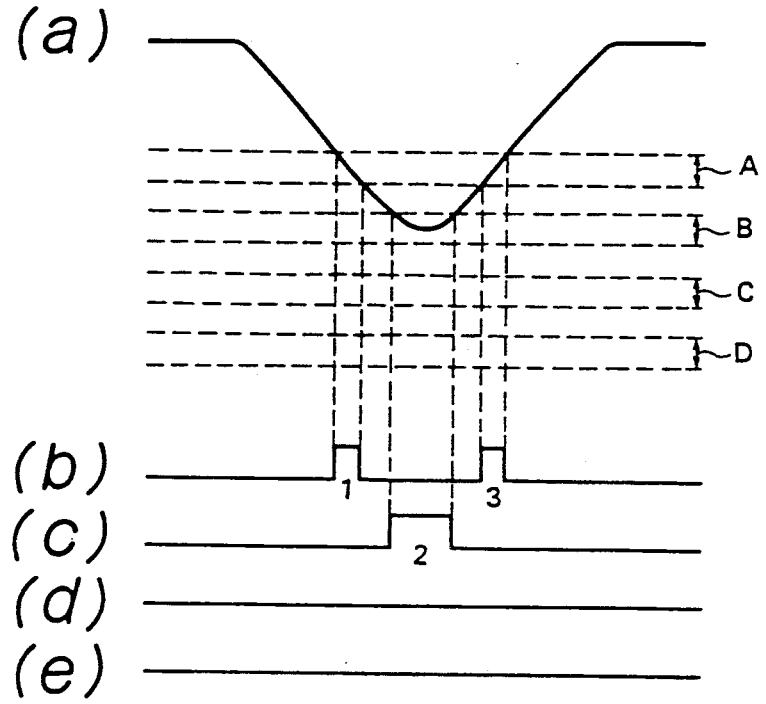

In the case of B-coin, the attenuating voltage waveform attenuates to window B and then rises to return to its original level, as shown in FIG. 8. The voltage waveform traverses the window A once when it attenuates and when it rises, respectively. Therefore, the window circuit 7 produces two pulses and the window circuit 8 produces one pulse, so that the count in the counter 15 becomes 3.

Figure 9:
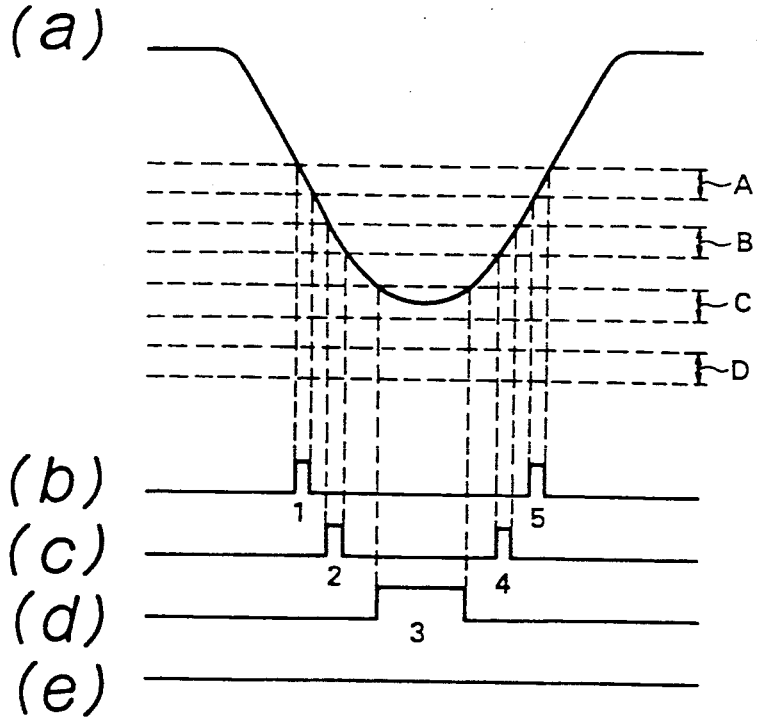

In the case of C-coin, the voltage waveform attenuates to window C and then rises to return to its original level, as shown in FIG. 9. The voltage waveform traverses the windows A and B when it attenuates and when it rises, respectively. Therefore, in that case, the window circuits 7 and 8 each produce two pulses and the window circuits 9 produces one pulse, so that the count in the counter 15 becomes "5".

Figure 10:
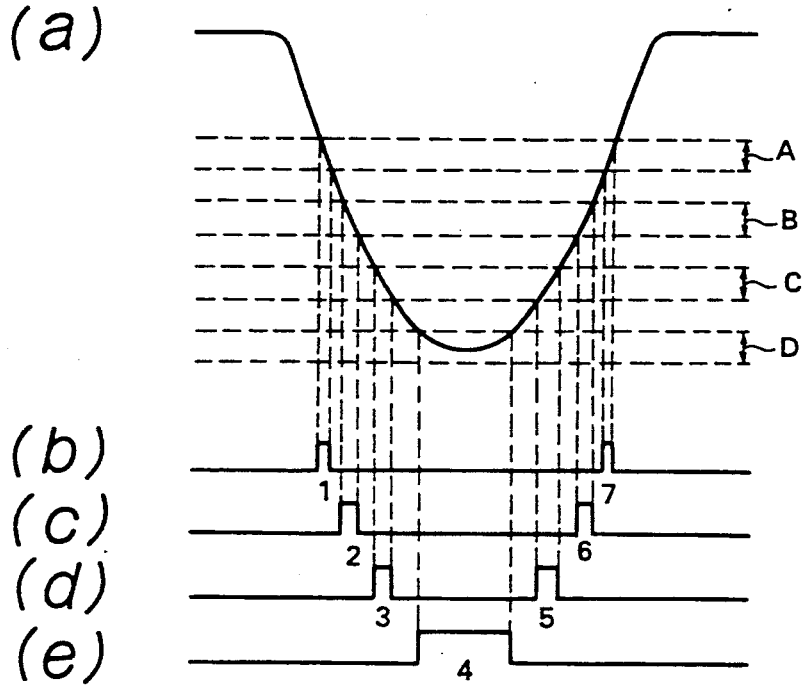

In the case of D-coin, the voltage waveform attenuates to window D and then returns to its original level, as shown in FIG. 10. The voltage waveform traverses the windows A, B and C when it attenuates and when it rises, respectively. Therefore, in that case, the window circuits 7, 8 and 9 each produce two pulses and the window circuit 10 produces one pulse, so that the count in the counter 15 becomes "7".

In summary, when the coin passing through the coin channel 1 is A-coin, the count in the counter 15 becomes "1"; when the coin is B-coin, the count becomes "3"; when the coin is C-coin, the count becomes "5"; and when the coin is D-coin, the count becomes "7". Any of these counts is an odd number.

Figure 11:
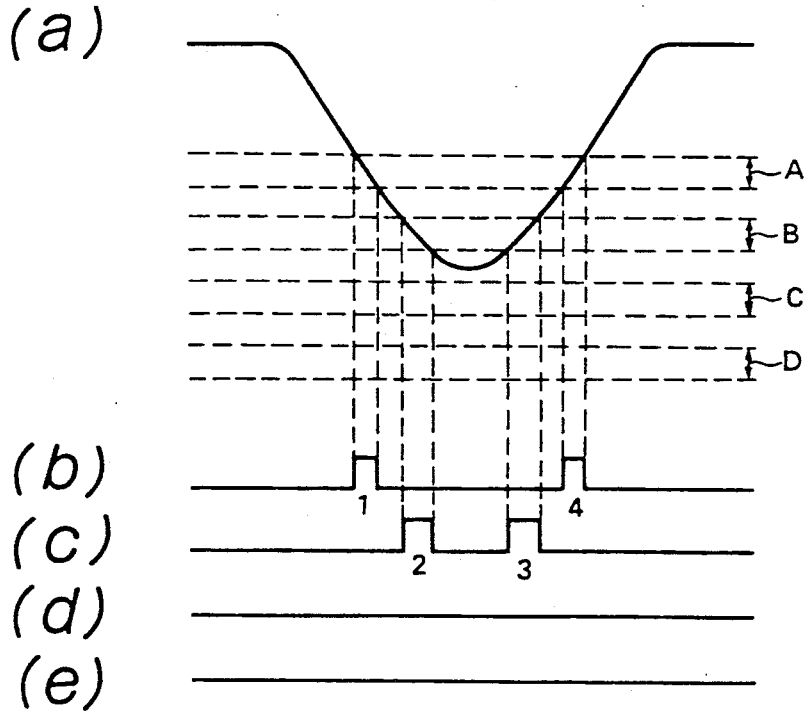

FIG. 11 shows one example of waveforms produced when the coin passing through the coin channel 1 is a false one. In that case, the maximum attenuation voltage of the voltage waveform does not belong to any of the windows A, B, C and D. For example, as shown in FIG. 11, the attenuation voltage waveform traverses windows A and B and returns to its original level. In that case, the window circuits 7 and 8 each produce two pulses, so that the count in the counter 15 become "4".

As just described above, when the coin passing through the coin channel 1 is a false one, the count in the counter 15 becomes an even number.

The output from counter 15 is input to a decoder 16 which outputs a signal indicative of detection of A-coin when the count in the counter 15 is "1"; a signal indicative of detection of B-coin when the count is "3"; a signal indicative of detection of C-coin when the count is "5"; and a signal indicative of detection of D-coin when the count is "7". The docoder 16 outputs a false-coin signal indicating that the deposited coin is a false one when the count in the counter 15 is an even number.

The signals output from the decoder 16 and indicating the detection of A-, B-, C-, and D-coins are input to the other input to the corresponding AND gates AN1, AN2, AN 3 and AN4.

Therefore, AND gate AN1 outputs an A-coin signal indicative of detection of A-coin only when it is determined by the timer 11 and by counter 15 and decoder 16 that the coin is A-coin. AND gate AN2 outputs a B-coin signal indicative of detection of B-coin only when it is determined by timer 12 and by counter 15 and decoder 16 that the coin is B-coin. AND gate AN3 outputs a C-coin signal indicative of detection of C-coin only when it is determined by timer 13 and by counter 15 and decoder 16 that the coin is C-coin. AND gate AN4 outputs a D-coin signal indicative of detection of D-coin only when it is determined by timer 14 and by counter 15 and decoder 16 that the coin is D-coin.

As just described above, A-, B-, and C-coin signals output from AND gates AN1–AN4 and a false coin signal output from decoder 16 are input to a coin discriminater (not shown) to discriminate a genuine coin or a false one, and the type of that coin.

While in the embodiment of FIG. 1 the times for timers 11, 12, 13 and 14 are set separately, as shown by T1, T2, T3 and T4, they may be the same value.

While in the embodiment of FIG. 1 a false coin signal is shown as being provided from the even-number output from decoder 16, an AND gate (not shown) which performs an AND operation on the respective inverses of the outputs from the timer circuits 11–14 may be provided in order to produce a false signal. Alternatively, a false signal may be obtained from an AND operation on the output from the AND gate and an even number output from decoder 16.

Figure 12:
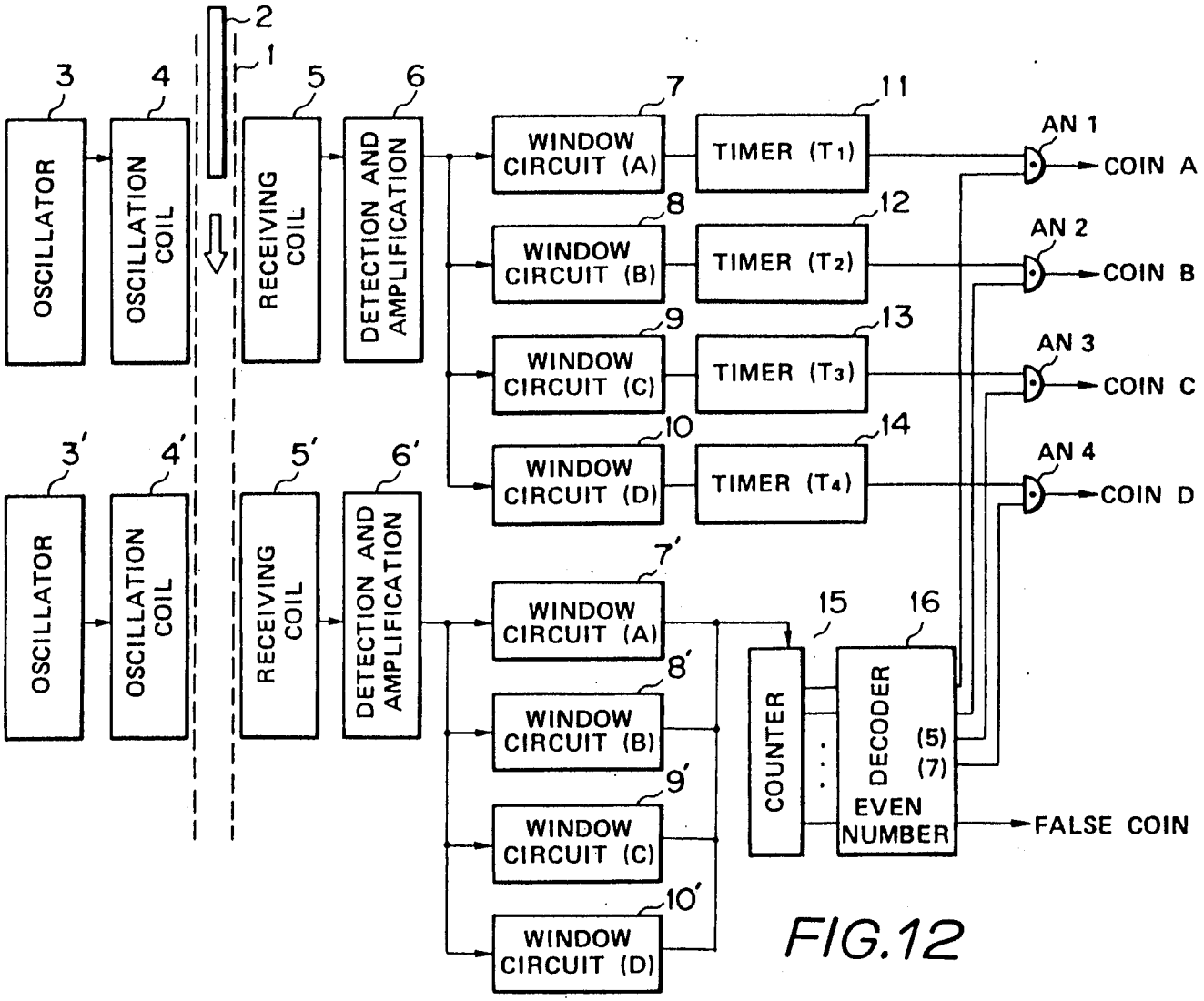
FIGS. 12–16 are block diagrams illustrating another embodiment of this invention.

FIG. 12 shows another embodiment of this invention. In this embodiment, oscillation coils 4 and 4' excited by oscillators 3 and 3', respectively, are disposed on one side of coin channel 1 while receiving coils 5 and 5' are disposed on the other side of the coil channel such that they oppose the oscillation coils 4 and 4', respectively. The output from the receiving coil 5 is applied via detection and amplification circuit 6 to window circuit 7, 8, 9 and 10 while the output from the receiving coil 5' is applied via detection and amplification circuit 6' to window circuits 7', 8', 9' and 10'. In this embodiment, the two pairs of oscillation and receiving coils are provided along the coin channel 1, one particular pair for the window circuits 7–10 and the other particular pair for the window circuits 7'–10'. The oscillation coils 4 and 4' are excited by the corresponding different frequencies, and separate windows for the respective frequencies are set in the corresponding window circuits 7–10 and 7'–10. In this embodiment, timers 11, 12, 13 and 14 determine A-, B-, C-, and D-coins in accordance with the outputs from window circuits 7, 8, 9 and 10, respectively, while the counter 1 which counts the outputs from the window circuits 7', 8', 9' and 10' and decoder 16 determine A-, B-, C- and D-coins. AND gates AN1, AN2, AN3 and AN4 which perform an AND operation on the outputs from the timers 11, 12, 13 and 14 and the output from decoder 16 provide signals indicative of detection of A-, B-, C- and D-coins.

The embodiment of FIG. 12 is the same in basic operation as the embodiment of FIG. 1 except for the use of oscillation coils 4 and 4' which are excited by the corresponding different frequencies.

Figure 13:
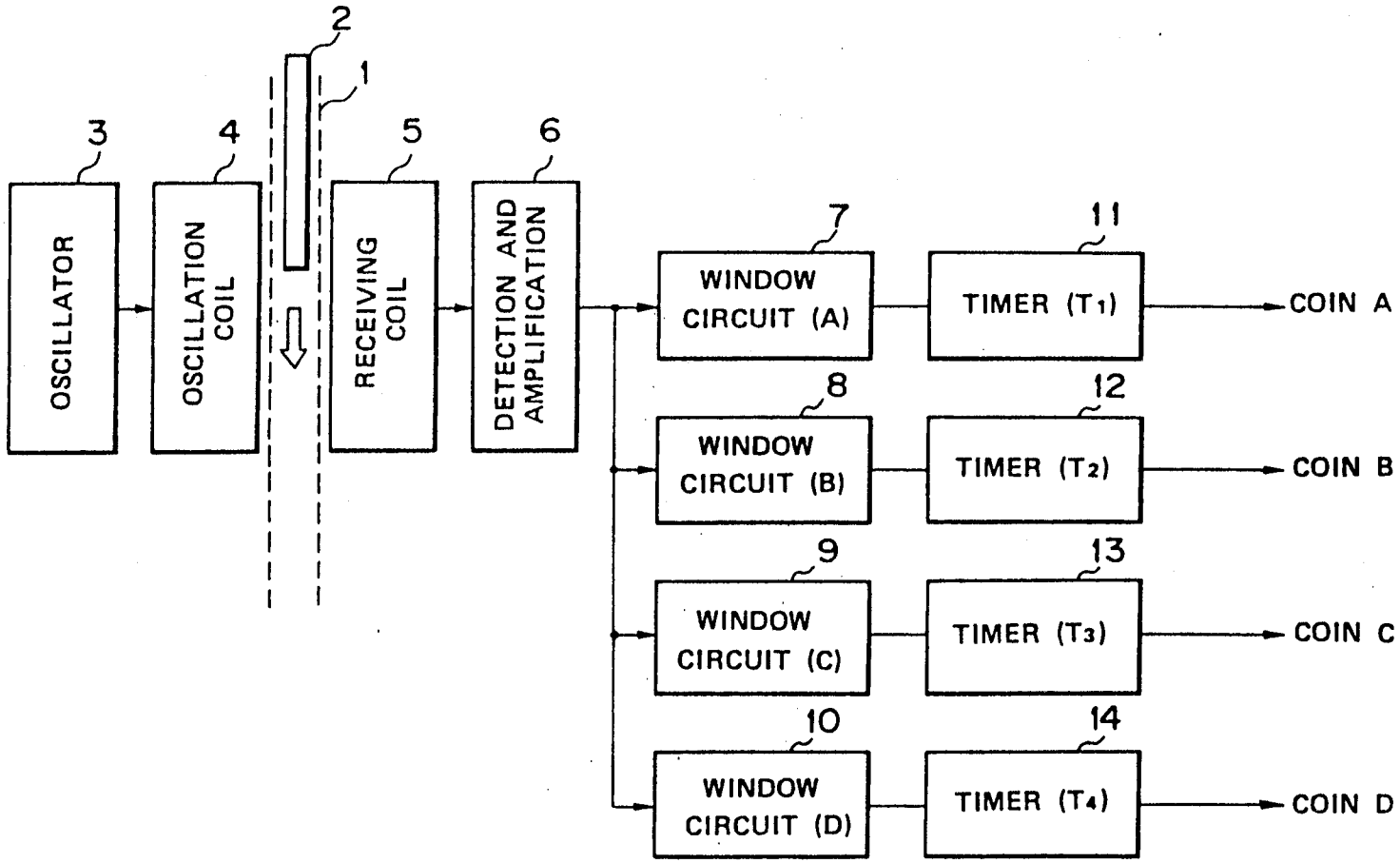

FIG. 13 shows another embodiment of this invention in which only timers 11, 12, 13 and 14 determine the validation and kind of a deposited coin. This circuit is basically the same in operation as the circuit which includes oscillator 3, oscillation coils 4, receiving coil 5, detection and amplification circuit 6, window circuits 7–10 and timers 11–14, shown in FIG. 1. Like reference numerals are used to identify like blocks in FIGS. 13 and 1 throughout for convenience of explanation.

Figure 14:
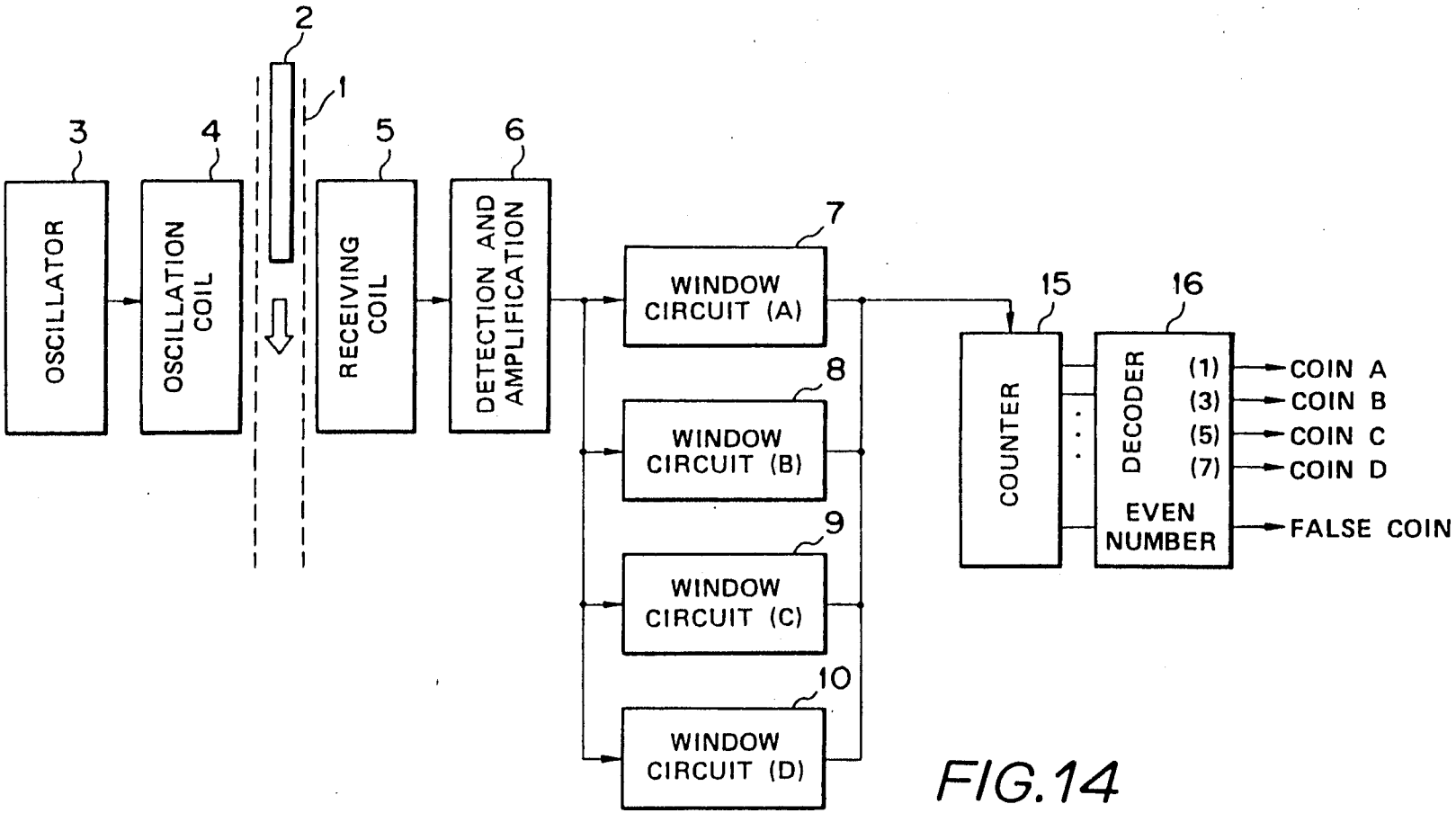

FIG. 14 shows a further embodiment of this invention in which the pulse signals output from window circuits 7, 8, 9 and 10 are counted by counter 15, the output of which is decoded by decoder 16, only the output of which in turn determines the validation and kind of the deposited coin. The circuit is basically the same in operation as the circuit which includes oscillator 3, oscillation coil 4, receiving coil 5, detection and amplification circuit 6, window circuits 7, 8, 9 and 10, counter 15 and decoder 16, shown in FIG. 1. Like reference numerals are used to identify like blocks also in FIGS. 14 and 1 throughout for convenience of explanation.

Figure 15:
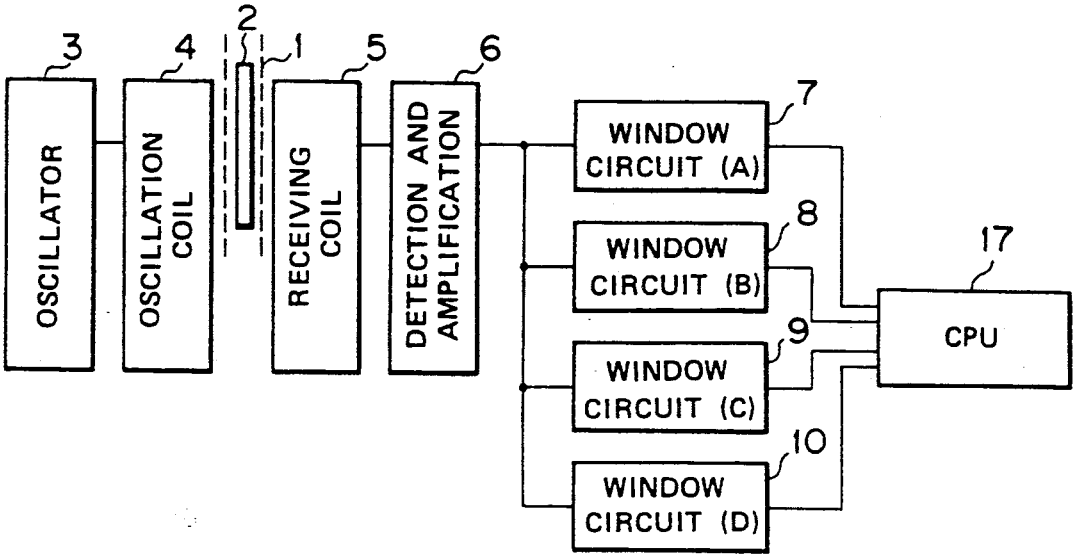
Figure 16:
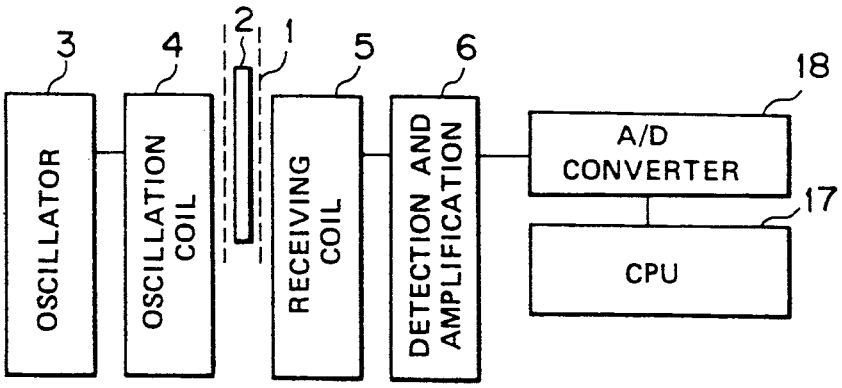

FIGS. 15 and 16 show other embodiments in which part of the circuit is constituted by a central processing unit (CPU). The embodiments of FIGS. 15 and 16 are similar in function to the embodiment, for example, shown in FIG. 1.

The embodiment of FIG. 15 is obtained, for example, by replacing with a CPU 17 the timers 11–14, OR gate OR1, counter 15 and decoder 16 and AND gates AN-1–AN4 of the embodiment shown in FIG. 1. In the embodiment of FIG. 16, the output from the detection and amplification circuit 6 is converted by an analog/-digital converter 18 to a digital signal which is then applied to CPU 17. CPU 17 serves functions, for example, similar to those of window circuits 7–10 in addition to those of timers 11–14, OR gate OR1, counter 15, decoder 16, AND gates AN1–AN4 of FIGS. 1. It is to be noted that part of the embodiments shown in FIGS. 12–14 may also be replaced with a central processing unit (CPU).

Figure 17:
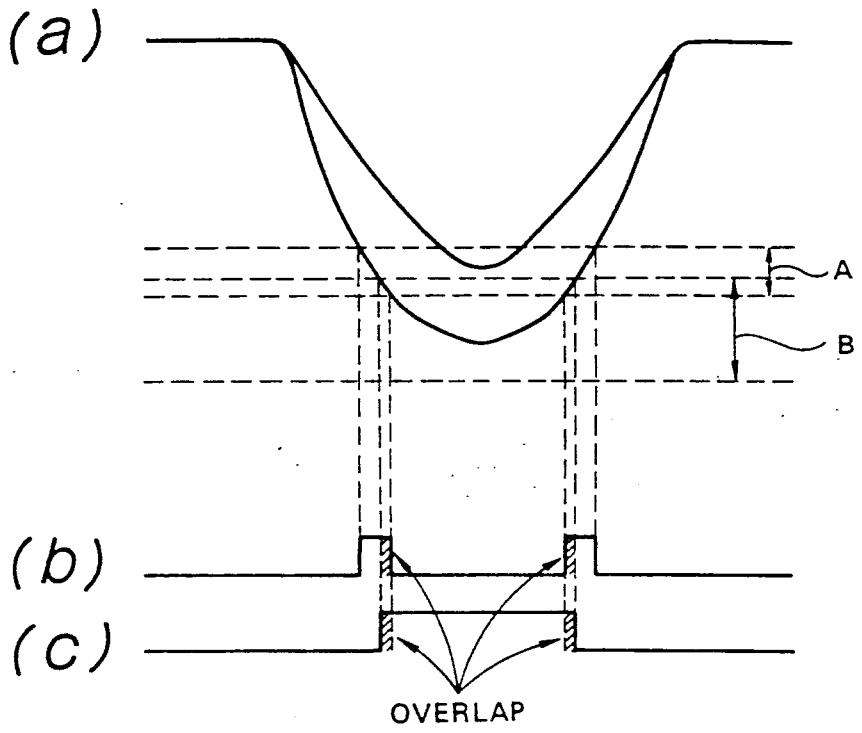
FIG. 17 is a waveform illustrating the operation of the device shown in FIG. 15.

In the embodiment shown in FIG. 15, the outputs from the window circuits 7, 8, 9 and 10 are input separately to CPU 17 in order to accurately count or determine pulse signals from the respective window circuits even if windows (A, B in FIG. 17) for two coins overlap, as shown in FIG. 17. If the windows for coins do not overlap, the outputs from the respective window circuits may be connected together.

While in any of the above embodiments the coins to be discriminated are shown as being four different ones; A-, B-, C-, D-coins, the number of types of coins is optional.

What is claimed is:

1. A coin selecting apparatus comprising:

a coin detection coil disposed in a coin channel for outputting a coin detection signal gradually attenuating from a predetermined level to an attenuation peak value and thereafter gradually increasing to return to the predetermined level as a coin passes through the coin channel, the attenuation peak value being different in accordance with different kinds of coins;

window means having a plurality of window circuits each set to detect the attenuation peak value of the coin detection signal of a single kind of coin differing from the remaining kinds of coins;

counting means for inputting the coin detection signal outputted from the coin detection coil into the window means as the coin passes through the coin channel where the coin detection coil is disposed and counting the number of entrances of the coin detection signal into all the window circuits of the window means as the coin detection signal attenuates and increases; and means for determining the validation and kind of the coin on the basis of the total count in the counting means.

2. A coin selecting apparatus according to claim 1, wherein the coin detection coil includes:

a first coil excited by a signal having a predetermined frequency; and a second coil disposed opposite the first coil across the coin channel for providing an output signal.

3. A coin selecting apparatus according to claim 1, wherein the window means includes a plurality of window comparators each of which produces a pulse signal rising when the coin detection signal enters the window and falling when the coin detection signal disappears from the window.

4. A coin selecting apparatus according to claim 3, wherein the counting means comprises counter means for counting the rising of the pulse signal.

5. A coin selecting apparatus according to claim 1, wherein the determining means determines that the coin is a false one when the count in the counting means is an even number and determines that the coin is a true one when the count is an odd number.

6. A coin selecting apparatus according to claim 1, wherein in the determining means determines the kind of the coin from the count in the counting means when the count is an odd number.

7. A coin selecting apparatus comprising:

a coin detection coil disposed in a coin channel for outputting a coin detection signal gradually attenuating from a predetermined level to an attenuation peak value and thereafter gradually increasing to return to the predetermined level as a coin passes through the coin channel, the attenuation peak value being different in accordance with the kind of the coin;

window means having a plurality of windows each set such that the attenuation peak value of the coin detection signal of respective kind of coins is included;

timer means for inputting the coin detection signal outputted from the coin detection coil into the window means as the coin passes through the coin channel, monitoring the time duration during which the coin detection signal is in the respective windows of the window means as the coin detection signal attenuates and increases, and producing a detection output corresponding to each window when the monitored time duration exceeds a predetermined period set in correspondence with each window; and means for determining the kind of the coin based on a window at which the timer means outputs the detection output.

8. A coin selecting apparatus according to claim 7, wherein the coin detection coil includes:

a first coil excited by a signal having a predetermined frequency; and a second coil disposed opposite the first coil across the coin channel for providing an output signal.

9. A coin selecting apparatus according to claim 7, wherein the window means comprises a plurality of window comparators each of which produces a pulse signal rising when the coin detection signal enters the window and falling when the coin detection signal disappears from the window.

10. A coin selecting apparatus according to claim 9, wherein the timer means generates a detection signal when the pulse width of the pulse signal exceeds a predetermined preset time.

11. A coin selecting apparatus according to claim 7, wherein the determining means determines that the coin is a false one when no detection signal is generated from the timer means.

12. A coin selecting apparatus comprising:

a coin detection coil disposed in a coin channel for outputting a coin detection signal gradually attenuating from a predetermined level to an attenuation peak value and thereafter gradually increasing to return to the predetermined level as a coin passes through the coin channel, the attenuation peak value being different in accordance with the kind of the coin;

window means having a plurality of windows each set such that the attenuation peak value of the coin detection signal of respective kind of coins in included;

counting means for inputting the coin detection signal outputted from the coin detection coil into the window means as the coin passes through the coin channel where the coin detection coil is disposed and counting the number of entrances of the coin detection signal into the respective windows of the window means as the coin detection signal attenuates and increases;

means for determining the validation and kind of the coin on the basis of the total count of the number of entrances of the counting means;

timer means for inputting the coin detection signal ouputted from the coin detection coil into the window means as the coin passes through the coin channel where the coin detection coil is disposed, monitoring the time duration during which the coin detection signal is in the respective windows of the window means as the coin detection signal attenuates and increases, and producing a detection output corresponding to each window when the monitored time duration exceeds a predetermined period set in correspondence with each window; and denomination signal generating means for generating a denomination signal corresponding to each denomination on the basis of the detection output of the detection means and the detection output of the timer means.

13. A coin selecting apparatus according to claim 12, wherein the coin detection coil includes:

a first coil excited by a signal having a predetermined frequency; and a second coil disposed opposite the first coil across the coin channel for providing an output signal.

14. A coin selecting apparatus according to claim 12, wherein the window means comprises a plurality of window comparators each of which produces a pulse signal rising when the coin detection signal enters the window and falling when the coin detection signal disappears from the window.

15. A coin selecting apparatus according to claim 14, wherein the counting means comprises counter means which counts the rising of the pulse signal.

16. A coin selecting apparatus according to claim 12, wherein the determining means determines that the coin is a false one when the count in the counting means is an even number and determines that the coin is a true one when the count is an odd number.

17. A coin selecting apparatus according to claim 12, wherein the determining means determines the kind of the coin from the count in the counting means when the count is an odd number.

18. A coin selecting apparatus according to claim 12, wherein the timer means generates a detection signal when the pulse width of the pulse signal exceeds a predetermined preset time.

19. A coin selecting apparatus according to claim 12, wherein the denomination signal generating means includes an AND circuit which performs AND operation of the determination output of the determining means and the detection output of the timer means corresponding to the determination output of the determining means.

20. A coin selecting apparatus comprising:

a first coin detection coil disposed in a coin channel for outputting a first coin detection signal gradually attenuating from a predetermined level to an attenuation peak value and thereafter gradually increasing to return to the predetermined level as a coin passes through the coin channel, the attenuation peak value being different in accordance with the kind of the coin;

a second coin detection coil disposed in the coin channel for outputting a second coin detection signal gradually attenuating from a predetermined level to an attenuating peak value and thereafter gradually increasing to return to the predetermined level as the coin passes through the coin channel, the attenuating peak value being different in accordance with the kind of the coin;

a first window means including a first window set such that the attenuating peak value of the first coin detection signal of respective kind of coins in included;

a second window means including a second window set such that the attenuation peak value of the second coin detection signal of respective kind of coins is included;

counting means for inputting the first coin detection signal outputted from the first coin detection coil into the first window means as the coin passes through the coin channel and counting the number of entrances of the first coin detection signal into the first window of the first window means as the first coin detection signal attenuates and increases;

means for determining the validation and kind of the coin on the basis of the total count of the number of entrances of the counting means;

timer means for inputting the second coin detection signal outputted from the second coin detection coil into the second window means as the coin passes through the coin channel, monitoring the time duration during which the second coin detection signal is in the second window of the second window means as the second coin detection signal attenuates and increases, and producing a detection output in accordance with each window when the monitored time duration exceeds a predetermined time set in correspondence with each window; and denomination signal generating means for generating a denomination signal corresponding to each denomination on the basis of the detection output of the detecting means and the detection output of the timer means.

21. A coin selecting apparatus according to claim 20, wherein the first coin detecting coil includes a first coil excited by a first signal having a predetermined frequency and a second coil disposed opposite the first coil across the coin channel for providing an output signal; and the second coin detection coil includes a third coil excited by a second signal having a predetermined frequency and a fourth coil disposed opposite the third coil across the coin channel for providing an output signal.

22. A coin selecting apparatus according to claim 21, wherein the frequency of the first signal and the frequency of the second signal are different with each other.

* * * * *